United States Patent [19]

Iwakiri et al.

[11] 4,346,275

[45] Aug. 24, 1982

[54] ILLUMINATED PUSHBUTTON SWITCH

[75] Inventors: Norio Iwakiri; Yasuhiro Kiyono, both of Nagaokakyo, Japan

[73] Assignee: Omron Tateisi Electronics Co., Kyoto, Japan

[21] Appl. No.: 176,759

[22] Filed: Aug. 11, 1980

[30] Foreign Application Priority Data

Aug. 21, 1979 [JP] Japan ..... 54-115409

[51] Int. Cl.[3] ..... H01H 9/16

[52] U.S. Cl. ..... 200/314

[58] Field of Search ..... 200/310, 311, 312, 313, 200/314, 317

[56] References Cited

U.S. PATENT DOCUMENTS 2,953,668 9/1960 Bassett ..... 200/313
4,268,735 5/1981 Iwakiri ..... 200/314

FOREIGN PATENT DOCUMENTS 2161800 7/1972 Fed. Rep. of Germany ..... 200/310
2825833 12/1979 Fed. Rep. of Germany ..... 200/314
2034118A 8/1979 United Kingdom .

*Primary Examiner*—John W. Shepperd
*Attorney, Agent, or Firm*—Wegner & Bretschneider

[57] ABSTRACT

An illuminated pushbutton switch including an elongated housing, a switching component accommodated within the housing, an actuating component coaxially housed in the housing for actuating the switching component in response to an external force, and an illuminating component for lightning an upper portion of the actuating component, said illuminating component comprising a lead frame, a pair of light emitting devices arranged on the lead frame, and an optically transparent member including a pair of transparent blocks corresponding to and embedding the light emitting devices, each of said blocks including a lens portion having an upper flat square surface and a nearly reverse conical side wall portion in which the light emitted from the corresponding one of the light emitting devices is defracted to radiate uniform light beams from the upper flat square surface, the upper flat square surface of the blocks constituting a continuous flat surface.

5 Claims, 6 Drawing Figures

ILLUMINATED PUSHBUTTON SWITCH

BRIEF SUMMARY OF THE INVENTION

The present invention relates to an illuminated pushbutton switch, and more particularly to an improved illuminated pushbutton switch comprising a plurality of light emitting devices.

There is well known an illuminated pushbutton switch comprising two interconnected light emitting devices, two lenses respectively associated therewith, and a single transparent cap lighted by the two light emitting devices through the two lenses. Such a conventional switch, however, has the disadvantage that a slit existing between two lenses produces an undesirable dark line in the lighted area of the transparent cap. Moreover, connecting two light emitting devices requires complicated assembling work.

It is, therefore, a primary object of the present invention to provide an illuminated pushbutton switch which may have an uniform illumination and is easy to assemble.

It is a further object of the present invention to provide an illuminated pushbutton switch which comprises a plurality of light emitting devices and a plurality of lenses associated with the respective light emitting devices, the lenses constituting a single unit and defracting light from the light emitting devices in order to radiate parallel and uniform light beams without a dark beam between neighboring lenses.

Other objects as well as the numerous advantages of the illuminated pushbutton switch according to the present invention will become apparent from the following detailed description and accompanying drawings, in which:

DETAILED DESCRIPTION

Figure 1:
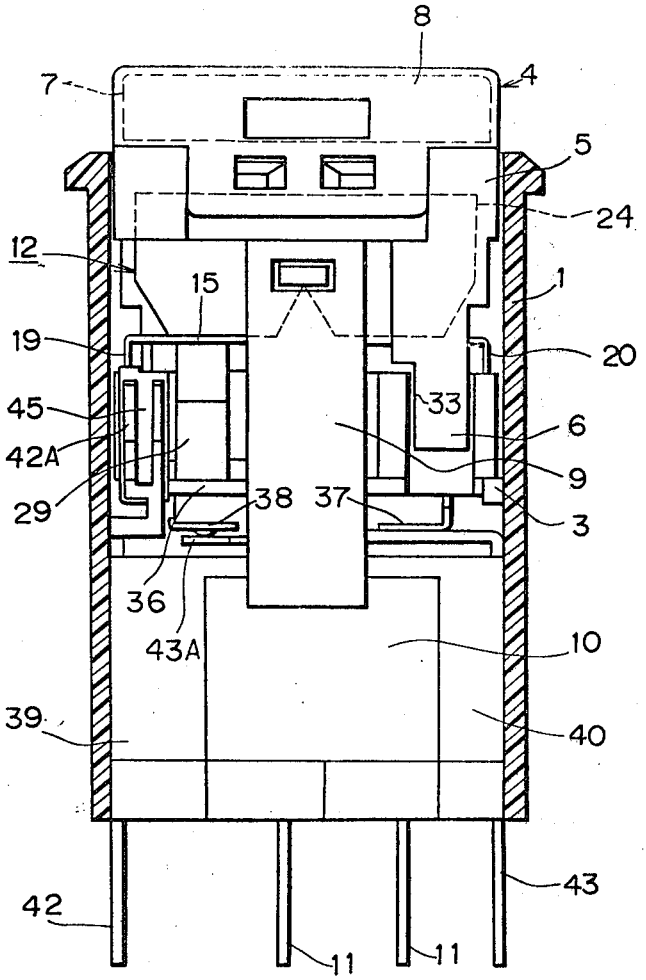
FIG. 1 is a front sectional view of an illuminated pushbutton switch as one embodiment of the present invention.
Figure 2:
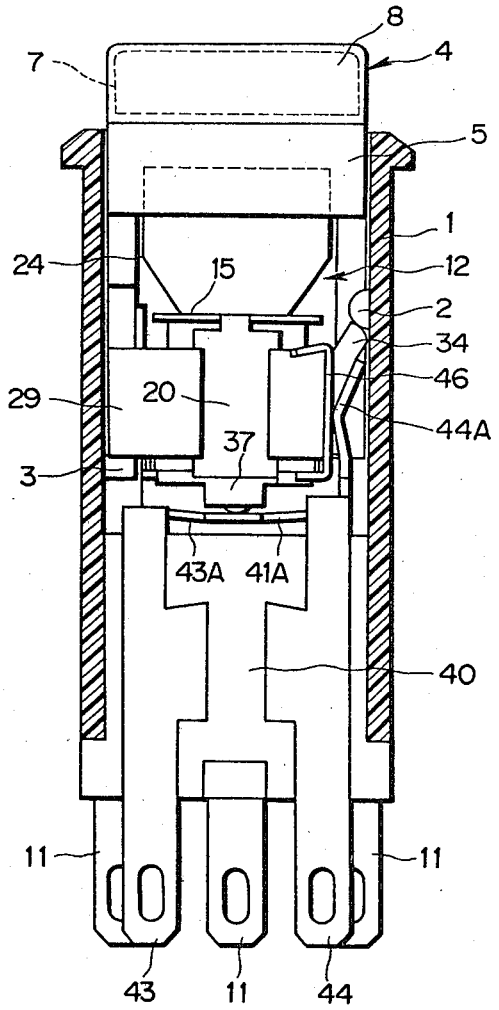
FIG. 2 is a side sectional view of the illuminated pushbutton switch of FIG. 1.

Referring, now, to FIGS. 1 and 2, there is shown an illuminated pushbutton switch comprising an elongated housing 1, an actuating component 4 removably housed within the housing 1 in an upper portion thereof, a switching component 10 installed in a lower portion of the housing 1, and an illuminating component 12 coupled with a holder 29 housed within the housing 1.

The actuating component 4 includes a frame 5, a colored cap 8 removably mounted on the frame 5, a diffuser 7 housed within the cap 8, and an actuating lever 9 engaged with the frame 5 at a side wall thereof. In response to an external force applied to the cap 8, the frame 5 is downwardly moved together with lever 9 and the lever 9 actuates switching component 10. The switching component 10 includes two precision snap-acting switches and six external terminals 11.

Figure 3:
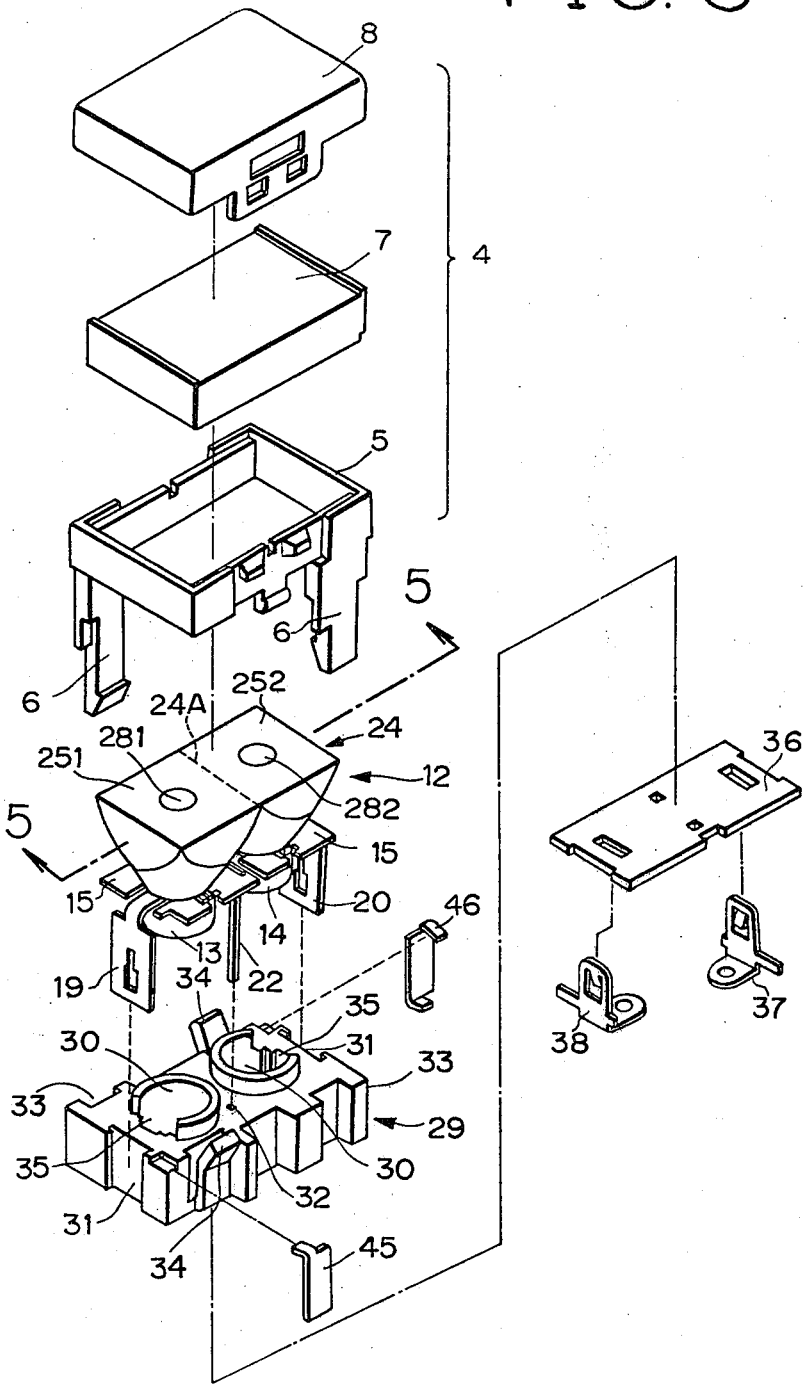
FIG. 3 is a perspective disassembled view showing the illuminating component and a part of the actuating component of the illuminated pushbutton switch of FIG. 1.
Figure 4:
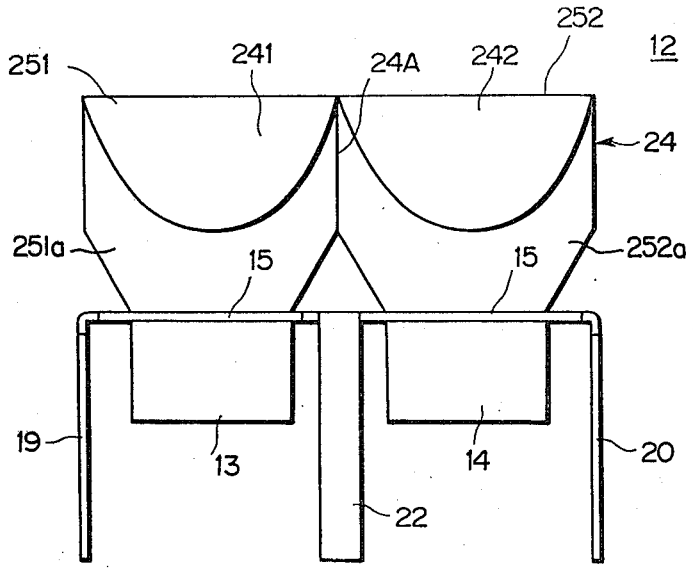
FIG. 4 is a side view showing the illuminating component of FIG. 3.
Figure 5:
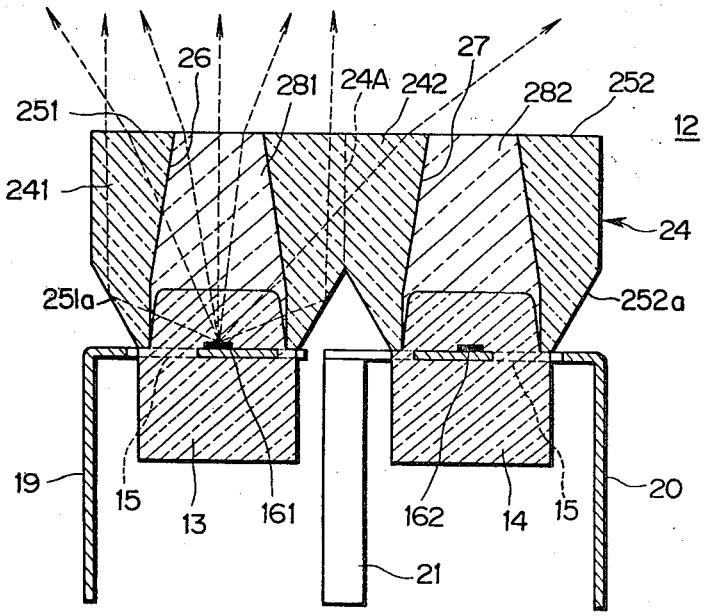
FIG. 5 is an elevational section view showing the illuminating component taken along the line 5—5 of FIG. 3.

The illuminating component 12 includes, as best shown in FIGS. 3, 4 and 5, lead frames 15, a pair of base units 13 and 14 respectively embedding a pair of light emitting devices 161 and 162, and a single lens unit 24 consisting of a pair of lens portions 241 and 242.

Figure 6:
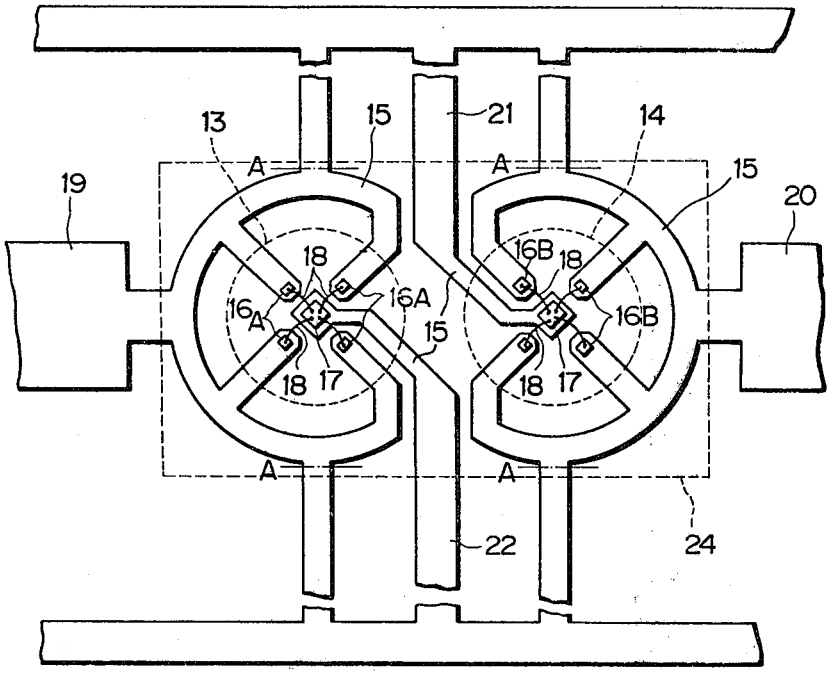
FIG. 6 is a top plan view showing the lead frames employed in the illuminating component of FIG. 3 as semiassembled.

In FIG. 6, there is shown the illuminated component 12 the peripheral leads of which have not been cut nor bent as yet. A single conductive plate is stamped out so as to shape the conductive pattern including frames 15 and terminal leads 19, 20, 21 and 22 as shown in FIG. 6. On the stamped-out lead frames 15, there are disposed the light emitting device 161 which consists of four light emitting diodes 16A and a resistor 17 wired to the diodes 16A by respective wires 18 and the light emitting device 162 which consists of four light emitting diodes 16B and a resistor 17 wired to the diodes 16B by respective wires 18. The respective light emitting devices 161 and 162 are, as best shown in FIGS. 5 and 6, held in a position and embedded in the respective base units 13 and 14 made of transparent epoxy resin which are formed by low pressure molding. And, then, the lead frames 15 are cut off along the one-dot-lines A as shown in FIG. 6. The four terminal leads 19, 20, 21 and 22 extending from the frames 15 are also cut off at proper lengthes and bent downwardly as shown in FIGS. 4 and 5. The conductive pattern of the frames 15 may be modified so that the frames 15 supporting a pair of resistors 17 are connected together so as to provide a single common terminal lead instead of the two leads 21 and 22. The lens unit 24 is a single molded unit made of acrylic resin which includes a pair of lower portions having conical configurations and a square continuous flat surface consisting of two square flat surfaces 251 and 252. The unit 24 is provided with a pair of axial holes 26 and 27 having nearly reverse conical shapes as shown in FIG. 5. The holes 26 and 27 are engaged with the base units 13 and 14, and are filled with transparent plastic cement or synthetic resin 281 and 282. Thus, the lens unit 24 and base units 13 and 14 are jointed together with the hardened cement 281 and 282 in a simplified manner, whereby the illuminating component 12 shown in FIG. 3 is provided. Alternatively, if desired, the illuminating component 12 may be formed by a modified process where the portion of the lens unit 24 and cements 281 and 282 are formed as a single unit with the base units 13 and 14 in a single molding process.

Returning to FIG. 3, as the illuminating component 12 has been coupled with the holder 29, the base units 13 and 14 come to be engaged with a pair of recessed portions 30 formed in a holder 29. At the same time, a pair of grooves 31 are engaged with the terminal leads 19 and 20, and a pair of holes 32 (one hole not visible in FIG. 3) are pierced by terminal leads 21 (not visible in FIG. 3) and 22. A pair of guide grooves 33 are engaged with a pair of guide legs 6 of the frame 5. The holder 29 and a printed circuit board 36 are jointed together by a pair of terminals 37 and 38 which pierce the board 36 and are secured to a pair of grooves 35. Thereafter, the terminals 37 and 38 and leads 19, 20, 21 and 22 are respectively soldered with a conductive pattern printed on the board 36.

In FIGS. 1 and 2, a pair of terminal blocks 39 and 40 are installed into the housing 1 so as to sandwitch the switching component 10.

On the outer side walls of the blocks 39 and 40 there are embedded terminals 41, 42, 43 and 44 for connection with the light emitting devices 161 and 162. The upper portions of the terminals 41 and 43 are horizontally extending so that the respective ends 41A and 43A thereof come in contact with the respective terminals 37 and 38. The terminals 42 and 44 respectively have upper portions 42A and 44A which are bent so as to provide contact with a pair of ⊐-shaped contact members 45 and 46 clamping the holder 29 and board 36. The contact members 45 and 46 are soldered to the conductive pattern printed on the board 36.

When the assembly of all the components shown in FIG. 3 has been installed into the housing 1 from upwards, a pair of resilient members 34 disposed on both side walls of the holder 29 slide over a pair of projections 2 opposedly formed on the inner walls of housing 1 and the holder 29 comes in contact with a pair of projections 3, whereby the assembled unit is supported by the housing 1.

Returning to FIG. 5, as the light emitting devices 161 and 162 are energized, the light emitted from the respective light emitting devices 161 and 162 is retracted to radiate uniform light beams from the respective upper surfaces 251 and 252. The emitted light striking the reverse conical side wall portions 251*a* and 252*a* is almost 100 percent reflected therefrom. Therefore, the light radiated from the surfaces 251 and 252 is diffused by the diffuser 7 and uniformly illuminates the cap 8 without any dark portion. The reverse conical side wall portions may be generally conical or parabolical in configuration so as to reflect all light emitted from the devices 161 and 162 and to thereby radiate more parallel and uniform light beams from the surfaces 251 and 252.

With the device 161 only having been energized, for example, only a very small porportion of light emitted therefrom leaks through the intermediate region 24A of lens unit 24, so that the half of cap 8 confronting the surface 251 is sharply illuminated. If the cap 8 is modified in such a manner that it consists of a pair of different colored caps corresponding to the surfaces 251 and 252, it will be understood that only one of the pair of caps may be sharply illuminated without the provision of any separator. In order to obtain more uniform illumination in the present embodiment, each of the surfaces 251 and 252 may be provided with a plurality of concentric concave segments.

As a modified embodiment of the present invention, each of the upper surfaces (251 and 252) of the lens unit (24) may be a different polygonal surface, for example, a triangular surface though depending on the configuration of the cap (8). Moreover, the lens portions (241 and 242) and the corresponding light emitting devices (161 and 162) may be more than two portions and devices, respectively.

It will be apparent from the foregoing description that the illuminated pushbutton switch according to the present invention includes a single molded transparent lens unit which defracts light emitted from a plurality of light emitting devices so as to radiate uniform light beams from the upper flat surface thereof and one may precisely fix the light emitting devices in a simple assembling operation. Moreover, the light emitting elements and resistor chips are disposed on the lead frames stamped out from a single sheet of conductive plate, whereby the wiring work for the light emitting elements is simplified and the assembling of the switch can be easily automated.

It should be understood that the above description is merely illustrative of the present invention and that many changes and modifications may be made by those skilled in the art without departing from the scope of the appended claims.

What is claimed is:

1. An illuminated pushbutton switch including an elongated housing, a switching component accomodated within said housing, an actuating component coaxially housed in said housing for actuating said switching component in response to an external force, and an illuminating component for lightning an upper portion of said actuating component, said illuminating component comprising a lead frame, a plurality of light emitting devices arranged on said lead frame, and an optically transparent member including a plurality of transparent blocks corresponding to and embedding said light emitting devices, each of said blocks including a lens portion having an upper flat polygonal surface and a nearly reverse conical side wall portion in which the light emitted from the corresponding one of said light emitting devices is reflected to radiate uniform light beams from the upper flat polygonal surface, the upper flat polygonal surface of said blocks constituting a continuous flat surface.

2. An illuminated pushbutton switch according to claim 1, wherein said upper flat polygonal surfaces are square and constitute a flat square surface.

3. An illuminated pushbutton switch according to claim 1, wherein said lead frame includes a plurality of leads having coplanar portions.

4. An illuminated pushbutton switch according to claim 1, wherein said optically transparent member consists of a single moulded lens unit having said plurality of lens portions with axial holes, a plurality of moulded base units respectively embedding said light emitting devices, with synthetic resin filled into said axial holes to unite said base units and said lens unit.

5. An illuminated pushbutton switch according to claim 1, wherein each of said light emitting devices includes a plurality of light emitting elements.

* * * * *